US006620239B2

(12) United States Patent
Yen

(10) Patent No.: US 6,620,239 B2
(45) Date of Patent: Sep. 16, 2003

(54) TRANSMISSION DEVICE FOR A CONTINUOUS TAPE

(75) Inventor: Ming-Hua Yen, Taipei Hsien (TW)

(73) Assignee: Mcaide Enterprise Co., Ltd., Tapei Hsien (TW)

( * ) Notice: Subject to any disclaimer, the term of this patent is extended or adjusted under 35 U.S.C. 154(b) by 0 days.

(21) Appl. No.: 10/025,607

(22) Filed: Dec. 26, 2001

(65) Prior Publication Data

US 2003/0041681 A1 Mar. 6, 2003

(51) Int. Cl.[7] ..... B05C 17/10

(52) U.S. Cl. ..... 118/76; 118/257; 156/577; 156/579; 242/588.3

(58) Field of Search ..... 118/76, 257; 156/577, 156/579; 242/588.3; 400/695, 696, 700

(56) References Cited

U.S. PATENT DOCUMENTS 6,206,072 B1 * 3/2001 Orihara et al. ..... 156/540

* cited by examiner

*Primary Examiner*—Laura Edwards
(74) *Attorney, Agent, or Firm*—Troxell Law Office PLLC

(57) ABSTRACT

A transmission device for a continuous tape comprises a casing, a tape release part, a relay part and a tape collect part. The casing extending a stationary release axle, a stationary relay axle and a stationary collect axle. The tape release part provides a release sleeve to rotationally fit with the release axle with a flange at a middle section thereof locating a correction tape wheel by way of engaging ribs on the periphery of the flange. The release part further provides a release gear with an axial release hole to be fixedly attached to the release sleeve. The relay part provides a big gear integrally joining a small gear with an axial relay hole to rotationally fit with the relay axle so as to be associated with the tape release part by way of the small gear meshing with the release gear. The tape collect part provides a collect gear integrally joining a big circular plate. A cylinder and a sleeve section extend from the circular plate with the sleeve section disposed in the cylinder and a through axial hole. The tape collect part rotationally fits with the collect axle with the collect gear meshing with the big gear of the relay part. When a correction tape wound on the correction wheel is released, the correction tape wheel turns together with the tape release part such that the relay part and the tape collect part can be driven with the tape release part and the tape collect part turning in the same direction.

4 Claims, 3 Drawing Sheets

TRANSMISSION DEVICE FOR A CONTINUOUS TAPE

BACKGROUND OF THE INVENTION

1. Field of the Invention

The present invention relates to a transmission device for a continuous tape and particularly to a transmission device, which is suitable for continuous tapes with different lengths.

2. Description of Related Art

A tape article or a continuous tape article such as a correction tape, a double-faced glue tape, fluorescent tape, or the like is often used in our daily life and usually the tape is received in a device such that the tape can be released on one hand and wound back on the other hand to avoid the tape being scattered over.

Taking the correction tape as an example, it is especially loved by students, document workers and draft-persons for whiting out the mistakes and making a necessary revise. Hence, it is an undoubted fact that the correction tape is getting popular since it is developed and available in the market.

A correction tape device generally is received in a casing composed of two opposite casing halves with a transmission device. The transmission device comprises a tape release axle and a tape collect axle, and the tape wound on the tape release axle can advance to the tape collect axle for being wound on the collect axle. While the correction tape device is in use, it is only necessary for the user to press and move an output tape part at the front end of the correction tape device and the tape can drive the tape release axle to release the rest part of the tape and the used tape section can be wound by the collect axle.

Obviously, the collect axle and the release axle provide the same rotational direction such that the tape has to be released on one hand and be collected on the other hand. In order to perform the purpose, generally an idle gear or a relay wheel is arranged between the two axles. Of course, each gear ratio can be preset in the transmission assembly for the releasing speed being in accordance with the collect speed.

However, it is sophisticate while the preceding transmission device is arranged in a limited room. Currently, the arrangement of the transmission device is that a tape release gear is placed a cylindrical body with a lower circular edge and then wheel axles are surrounded with the tape and rotationally fit with the cylindrical body. The wheel axles are attached with gears so that the outer diameter of each wheel axle for winding the tape is not greater than the secondary gear and the lower circular edge.

Although the preceding conventional arrangement can provide a basic function of the correction tape device, specific tape release axles have to be designed for tapes in different lengths such as 600 cm or 800 cm for students in primary school and 1,600 cm for office people respectively. That is, a specific transmission device is made for a specific length of tape at the present time so that it is tedious and costly for fabricating different specifications of correction tape device because of providing different molding tools, different material preparations and different working procedures.

SUMMARY OF THE INVENTION

Accordingly, an object of the present invention is to provide a transmission device for a continuous tape, which is suitable for all continuous tapes in different lengths, such that it is simple and economical for the user to perform a desired work with the continuous tape conveniently and effectively.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
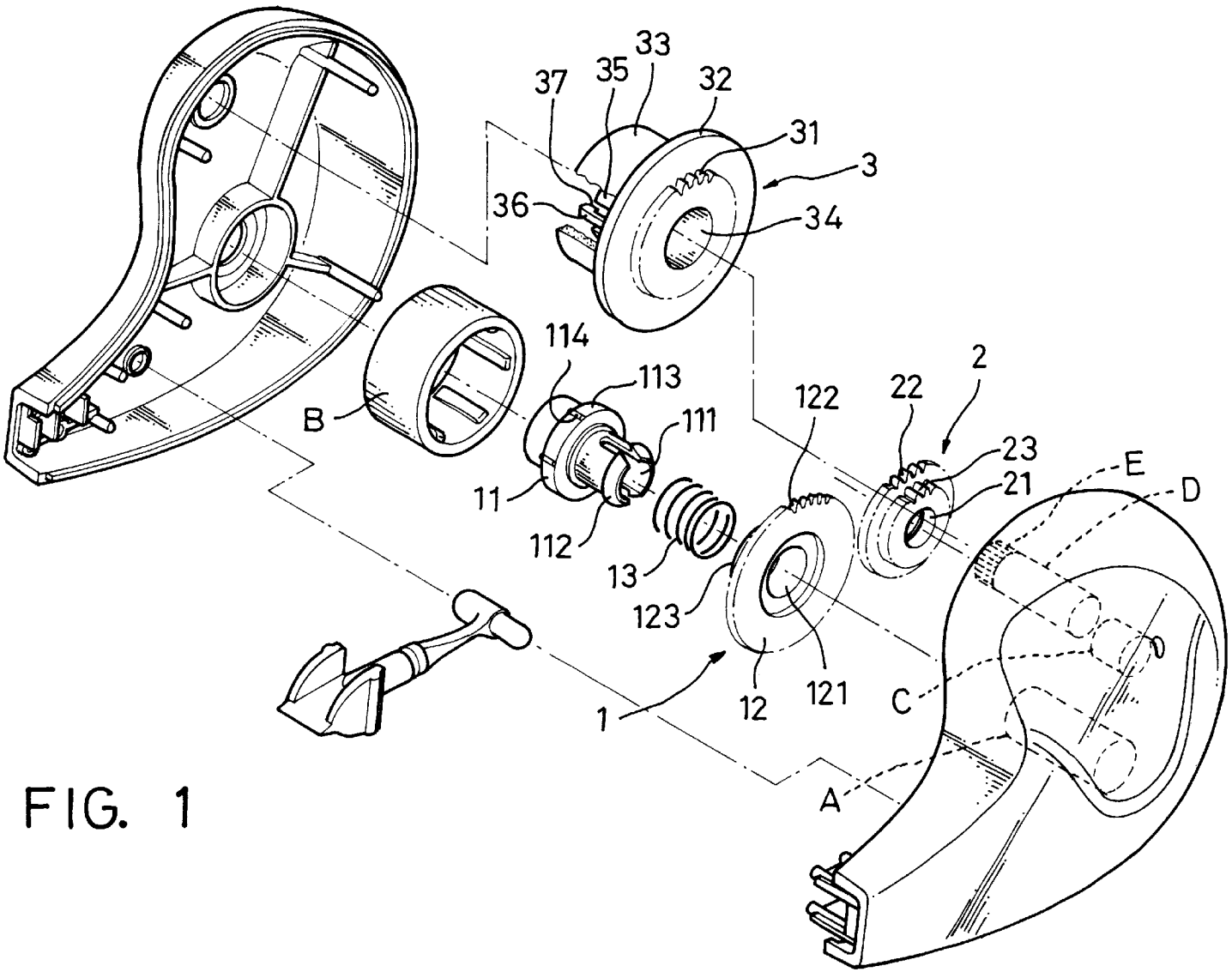
FIG. 1 is an exploded perspective view of transmission device for a continuous tape according to the present invention.
Figure 2:
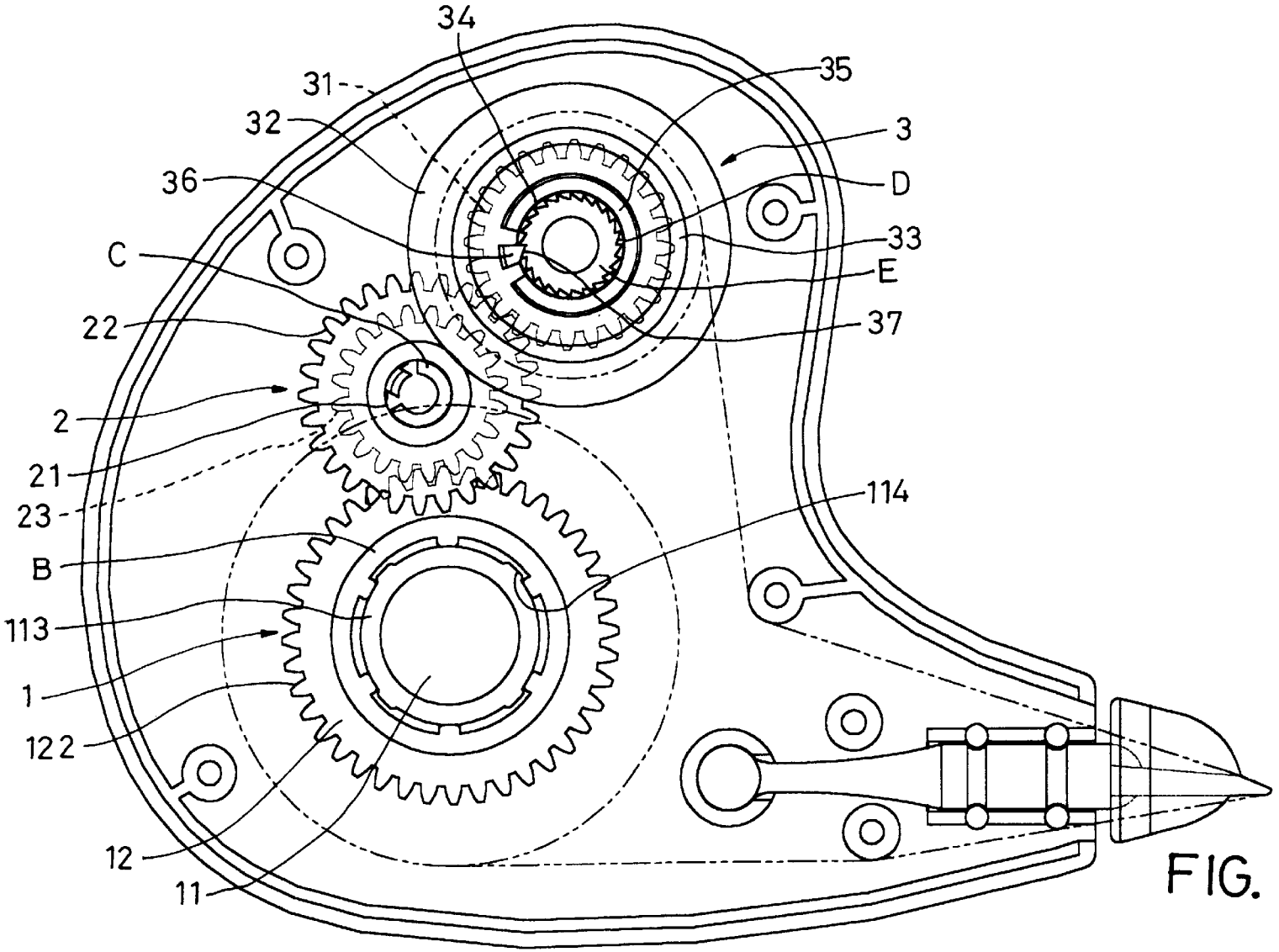
FIG. 2 is a front view of the transmission device for a continuous tape according to the present invention.
Figure 3:
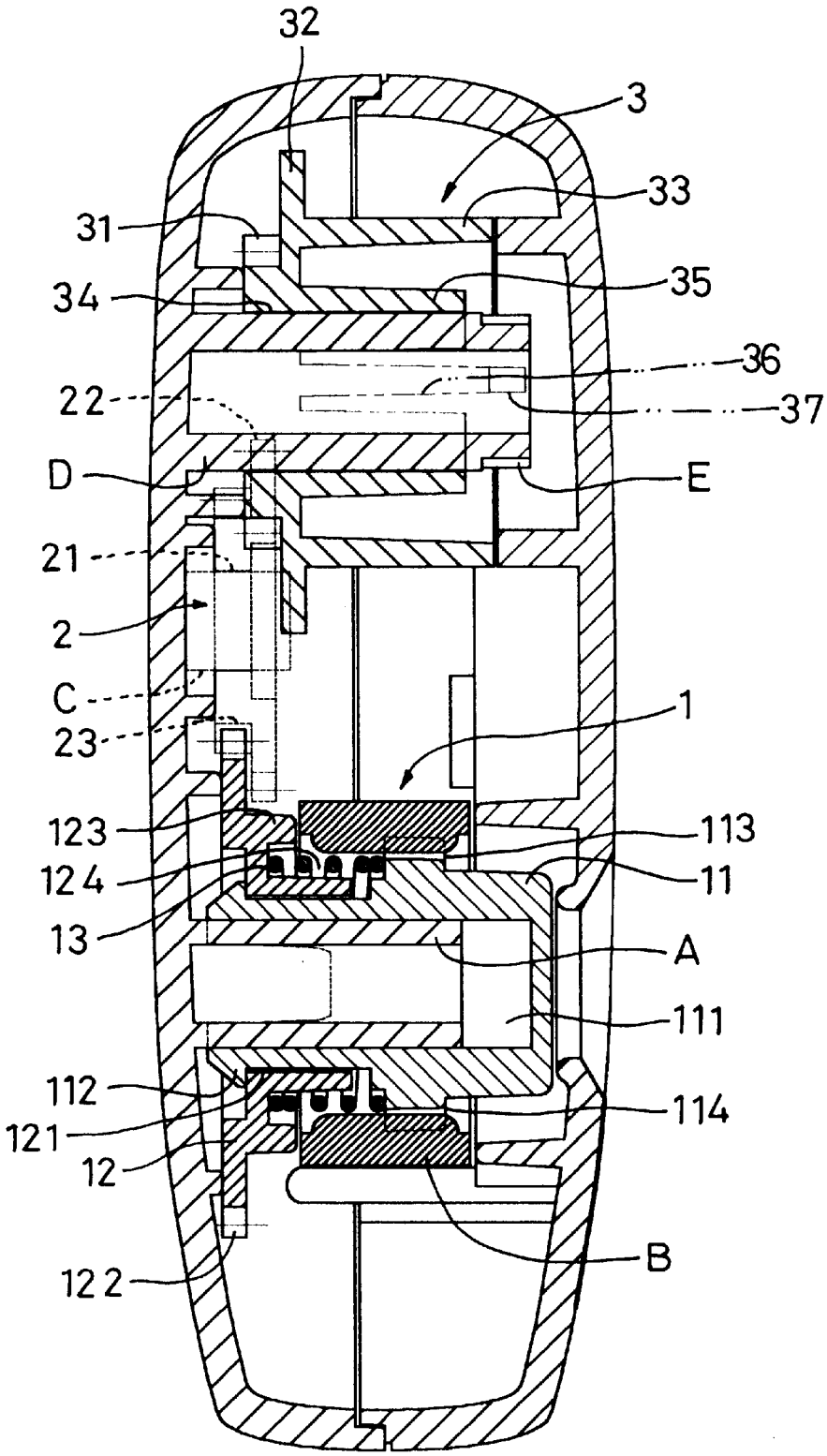
FIG. 3 is a side view of the transmission device for a continuous tape according to the present invention.

Referring to FIGS. 1, 2 and 3, the transmission device for a continuous tape according to the present invention comprises a tape release part 1, a relay part 2 and a tape collect part 3. The embodiment illustrated in FIGS. 1, 2 and 3 is applied to a correction tape, but it is noted that the transmission device of the present invention is possible for any continuous tape except the correction tape without any restriction.

Wherein, the tape release part 1 further comprises a release sleeve 11, a release gear 12, and a release spring 13. The release sleeve 11 provides an axial fitting hole 111 corresponding to a release axle A extending from a casing half part such that the tape release part 1 can rotationally fit with the release axle A and can turn by traction of the correction tape. The release sleeve 11 at an end thereof has two opposite split sleeve halves 112 to be pressed inward for fitting with a release gear 12. An outer diameter formed by the sleeve halves 112 is smaller than a flange 113 disposed in the middle section thereof and the flange 113 at the periphery thereof provides a plurality of engaging ribs 114 for locating a correction tape wheel B. The release gear 12 provides an axial hole 121 to engage with the sleeve halves 112 and provides gear teeth 122 to mesh with the relay part 2. In order to avoid a speed difference between tape releasing and tape collecting, the release gear 12 provides an inner gear ring 123 at the wall surface surrounding the axial hole 121 to form a gear seat space 124 between the gear ring 123 and the release sleeve 11 for accommodating a release spring 13.

The relay part 2 is a gear assembly with an axial relay hole 21 to fit with a relay axle C extended from the casing half so that the relay assembly 2 can rotate around the relay axle C. The relay assembly C provides a big relay gear 22 next to a small relay gear 23 and the small relay gear 23 meshes with the release gear 12 so that the release gear 12 can rotate in a direction opposite to that of the small relay gear 23. The relay part 2 is an integral piece as shown in FIG. 1 and it is preferable that the relay part 2 is made of high molecular by way of injection molding.

The tape collect part 3 at an end thereof has a tape collect gear 31 with an axial collect hole 34 integrally joining a big circular plate 32 and a collect axle D extending from the casing half. A collect cylinder 33 extends from the big ring 1 toward the other end of the collect part 3 with a diameter thereof smaller than the circular plate 32. The collect cylinder 33 is used for collecting the correction tape and the circular plate 32 is used for limiting the lateral movement of the correction tape. In order to prevent the correction tape from turning inversely, a sleeve section 35 extends from the circular plate 32 in the collect cylinder 33 with a split clearance. An engaging strip 36 is extended in the clearance with a ratchet end 37 to engage with the ring teeth E at the outer end of the collect axle D such that the collect part 3 is unable to turn inversely.

Referring to FIGS. 1 to 3 again, the release gear 12 is arranged to fit with the release sleeve 11 and the release spring 13 is placed between the release gear 12 and the release sleeve 11. Then, the axial hole of the release sleeve 11 fits with the release axle A and the correction tape wheel with wound correction tape can be attached to the release sleeve 11 by way of engaging ribs 114. The relay hole 21 of the relay part 2 fits with the relay axle C in a way of the small relay gear 21 facing the relay axle C. The axial collect hole 34 of the collect part 3 fits with the collect axle D and the head end of the correction tape is fixed to the collect cylinder 33. Further, the correction tape can be arranged in a state of roundabout way with the positioning posts in a conventional casing. When the transmission device of the present invention is in use, the tape release part 1, the delay part 2 and the tape collect part 3 can rotate at the same time as soon as the correction tape at the sharp end of the casing is daubed on the corrected spot. It is noted that the tape release part 1 and the tape collect part 3 rotates in the same direction and the delay part 2 rotates along a direction reversed to that of the release part 1 or the tape collect part 3. Once the release tape has a speed different from that of the collect tape, it can be adjusted by way of the release spring 13. In the meantime, ratchet end 37 engages with the ring teeth E on the collect axle D so that it is not possible for the collect part 3 to turn in a reversed direction and prevent from the phenomenon of backing tape.

It is appreciated from the foregoing that the present invention can release and collect the correction tape by way of the tape release part 1, the relay part 2 and the collect part in the transmission device of the present invention. Further, the present invention is suitable for correction tapes in different lengths instead of different transmission devices for different tape lengths done by the prior art. Hence, the only single transmission device of the present invention possible for all tapes in different lengths can simplify the production and the material preparation while the transmission device of the present invention is made. Theses advantages are not possible for the prior art to reach effectively.

While the invention has been described with reference to a preferred embodiment thereof, it is to be understood that modifications or variations may be easily made without departing from the spirit of this invention, which is defined in the appended claims.

What is claimed is:

1. A transmission device for a continuous tape, comprising:

a casing, extending a stationary release axle, a stationary relay axle and a stationary collect axle;

a tape release part, providing a release sleeve to rotationally fit with the release axle with a flange at a middle section thereof and a plurality of engaging ribs on a periphery thereof for locating a correction tape wheel, and providing a release gear with an axial release hole to be fixedly attached to the release sleeve;

a relay part, providing a big gear integrally joining a small gear with an axial relay hole to rotationally fit with the relay axle, and being associated with the tape release part by way of the small gear meshing with the release gear;

a collect part, providing a collect gear integrally joining a big circular plate with a cylinder and a sleeve section in the cylinder extending from the circular plate, providing an axial collect hole to rotationally fit with the collect axle, and the collect gear meshing with the big gear of the relay part;

whereby, when a correction tape wound on the correction wheel is released, the correction tape wheel turns together with the tape release part and the relay part and the tape collect part can be driven to rotate as well with the tape release part and the tape collect part turning in the same direction.

2. The transmission device for a continuous tape according to claim 1, wherein the release gear provides an inner gear ring at an wall surface surrounding the axial release hole to form a seat space between the inner gear ring and the release sleeve for accommodating a release spring.

3. The transmission device for a continuous tape according to claim 1, wherein the sleeve section of the tape collect part provides a split clearance and extends an engaging strip with a ratchet end in the clearance to engage with a ring gear end provided on the collect axle so as to resist the tape collect part rotating in a reversed direction only.

4. The transmission device for a continuous tape according to claim 1, wherein the continuous tape is a correction tape, a double-faced glue tape, a fluorescent color tape, or any other tape available for being released or collected synchronously.

* * * * *